US008016174B2

(12) United States Patent
Almeras et al.

(10) Patent No.: US 8,016,174 B2
(45) Date of Patent: Sep. 13, 2011

(54) INDIRECT FIRE DEVICE FOR FIXING FASTENERS IN A SUBSTRATE MATERIAL

(75) Inventors: Roland Almeras, Touron (FR); Patrick Herelier, Saint-Jean-de-Muzols (FR); Emmanuel Vallon, Portes les Valence (FR)

(73) Assignee: Societe de Prospection et d'Inventions Techniques Spit, Bourg les Valence (FR)

( * ) Notice: Subject to any disclaimer, the term of this patent is extended or adjusted under 35 U.S.C. 154(b) by 588 days.

(21) Appl. No.: 10/597,377

(22) PCT Filed: Jan. 21, 2005

(86) PCT No.: PCT/IB2005/000162

§ 371 (c)(1),
(2), (4) Date: Jun. 27, 2008

(87) PCT Pub. No.: WO2005/070623

PCT Pub. Date: Aug. 4, 2005

(65) Prior Publication Data

US 2008/0251560 A1 Oct. 16, 2008

(30) Foreign Application Priority Data

Jan. 23, 2004 (FR) ..... 04 00664

(51) Int. Cl.
*B25C 1/08* (2006.01)

(52) U.S. Cl. ..... 227/10; 227/9; 227/119

(58) Field of Classification Search ..... 227/8, 9, 227/10, 119, 120; 198/747
See application file for complete search history.

(56) References Cited

U.S. PATENT DOCUMENTS

| | | | | |
|---|---|---|---|---|
| 4,581,964 | A * | 4/1986 | Takatsuru | 81/464 |
| 6,237,747 | B1 * | 5/2001 | Gantner et al. | 198/747 |
| 6,267,284 | B1 * | 7/2001 | Clark | 227/8 |
| 6,722,551 | B2 * | 4/2004 | Weibel et al. | 227/10 |
| 2002/0027150 | A1 * | 3/2002 | Hamada et al. | 227/119 |
| 2005/0247751 | A1 * | 11/2005 | Wywialowski et al. | 227/136 |

FOREIGN PATENT DOCUMENTS

| | | |
|---|---|---|
| EP | 0972951 A | 1/2000 |
| EP | 0987086 A | 3/2000 |

* cited by examiner

*Primary Examiner* — Sameh H. Tawfik
*Assistant Examiner* — Nathaniel Chukwurah
(74) *Attorney, Agent, or Firm* — Lowe Hauptman Ham & Berner, LLP

(57) ABSTRACT

An indirect fire device for fixing fasteners in a substrate material includes a piston for driving a fastener movably mounted in a barrel and a plug guide for guiding a fastener towards the substrate material. The device is adapted to receive a magazine for receiving a strip of fasteners in order to introduce the fasteners one by one into the plug guide. Each fastener is held in a sleeve comprising bridges for connection to another sleeve. The plug guide of the device includes a zone having an enlarged circular section at the opening of the magazine leading into the plug guide, extending axially over the length of a sleeve increased by the stroke of the plug guide for loading the device.

16 Claims, 3 Drawing Sheets

INDIRECT FIRE DEVICE FOR FIXING FASTENERS IN A SUBSTRATE MATERIAL

RELATED APPLICATIONS

The present application is a National Phase application based on International Application Number PCT/IB 2005/000162, filed Jan. 21, 2005, which claims priority from, French Application Number 0400664, filed Jan. 23, 2004, the disclosures of which is hereby incorporated by reference herein in its entirety.

The invention relates to an indirect fire device for fixing fasteners in a substrate material.

Referring to FIG. 1, an indirect fire fixing device 1 allows for the introduction of a fastener 2, e.g. a nail, including a head 2' and a shank 2" into a substrate material. The fastener 2 is driven, e.g. by an explosive mixture, by means of a piston movably mounted in a barrel and a plug guide 3 extending along an axis 9.

The nails 2 are loaded into the device 1 in the form of a nail strip 4. Each nail 2 is engaged by means of its shank 2" in a sleeve 5, the sleeves 5 being connected together by diametrically opposing shearable connecting means 6, referred to here as bridges 6, on each sleeve 5. The bridges 6 are in this case two in number on each side of a sleeve 5. The nails 2 are thus disposed in parallel within the strip 4, the sleeves 5 enclosing them being connected in pairs by the bridges 6.

The assembly formed by a nail 2 and a sleeve 5 will be referred to in the remainder of the description as a fastening assembly or an assembly.

The strip 4 is disposed in a magazine 7 extending substantially perpendicularly to the plug guide 3. A return spring placed at the end of the magazine 7 opposite the plug guide 3 pushes the strip 4 in the direction of the plug guide 3. The fastening assembly (2, 5) opposite the spring is thus introduced into the plug guide 3, its axis coinciding with the axis of the latter. Upon firing, its bridges 6 are sheared, thereby separating it from the adjacent assembly (2, 5) which is then pushed towards the plug guide 3 by the return spring.

The inner diameter of the plug guide 3 is substantially equal to the largest outer diameter of the sleeves 5, covering the bridges 6, in order to ensure that it is guided correctly to its end, the bridges 6 being flattened against the wall of the bore of the plug guide 3 during the stroke of a fastening assembly (2, 5).

The bridges 6 project from the outer surfaces of the sleeves 5. A groove 8 for housing bridges 6 is therefore provided in the wall of the bore of the plug guide 3, diametrically opposite the magazine 7. The bridges 6 of the sleeve 5 introduced into the plug guide 3 which are free are thus housed in the groove 8, the magazine 7 being arranged on the plug guide 3 in such a manner that the bridges 6 rigidly connected to the strip 4 are also disposed outside the bore of the plug guide 3. The diameter of the latter is therefore adapted perfectly to the outer diameter of the sleeves 5.

The magazine 7 and its spring make the strip 4 move in strict translation, thereby ensuring that the free bridges of a sleeve 5 introduced into the plug guide 3 are placed correctly in the groove 8 as it is rigidly connected to the strip 4. Referring to FIG. 2, the last fastening assembly (2, 5) of the strip 4 is not rigidly connected to any other assembly (2, 5). In FIG. 2, the last assembly (2, 5) has been introduced correctly into the plug guide 3, its bridges 6 opposite the spring being housed in the groove 8. However, during the phase in which it is introduced into the plug guide 3, this assembly (2, 5) can be made to rotate about its axis by friction against a wall of the magazine 7. The bridges 6 are then no longer positioned correctly, the sleeve 5, with its bridges 6 projecting, having a greater maximum outer diameter than that of the bore of the plug guide 3. In order to compensate for this difference in diameter, with the return spring pushing it into the plug guide 3, the fastening assembly (2, 5) is positioned along a different axis from the axis of the plug guide 3, i.e. it is not introduced in its entirety into the plug guide 3, thereby causing malfunction of the device and the incorrect introduction of the nail 2 into its substrate.

The aim of this invention is to obviate this disadvantage.

To this end, the invention relates to an indirect fire device for fixing fasteners in a substrate material, comprising a piston for driving a fastener movably mounted in a barrel and a plug guide for guiding a fastener towards the substrate material, the device being adapted to receive a magazine for receiving a strip of fasteners in order to introduce the fasteners one by one into the plug guide, each fastener being held in a sleeve comprising shearable means for connection to another sleeve, the device being characterised in that the plug guide includes a zone having an enlarged, preferably circular, section at the opening of the magazine leading into the plug guide.

Finally, the invention consists in being bold enough to provide, so to speak, a groove extending over an angle of 360°.

In the preferred embodiment of the invention, as the sleeves are connected together by means of bridges, the zone having an enlarged section has a diameter substantially equal to the diameter of the plug guide increased by the radial dimensions of a bridge.

The zone having an enlarged section preferably extends axially over the length of a sleeve increased by the stroke of the plug guide for loading the device.

The zone having an enlarged section is advantageously connected by means of a truncated portion to the remainder of the bore of the plug guide.

The invention will be more readily understood with the aid of the following description of the preferred embodiment of the device of the invention, with reference to the accompanying drawings, in which.

Figure 1:
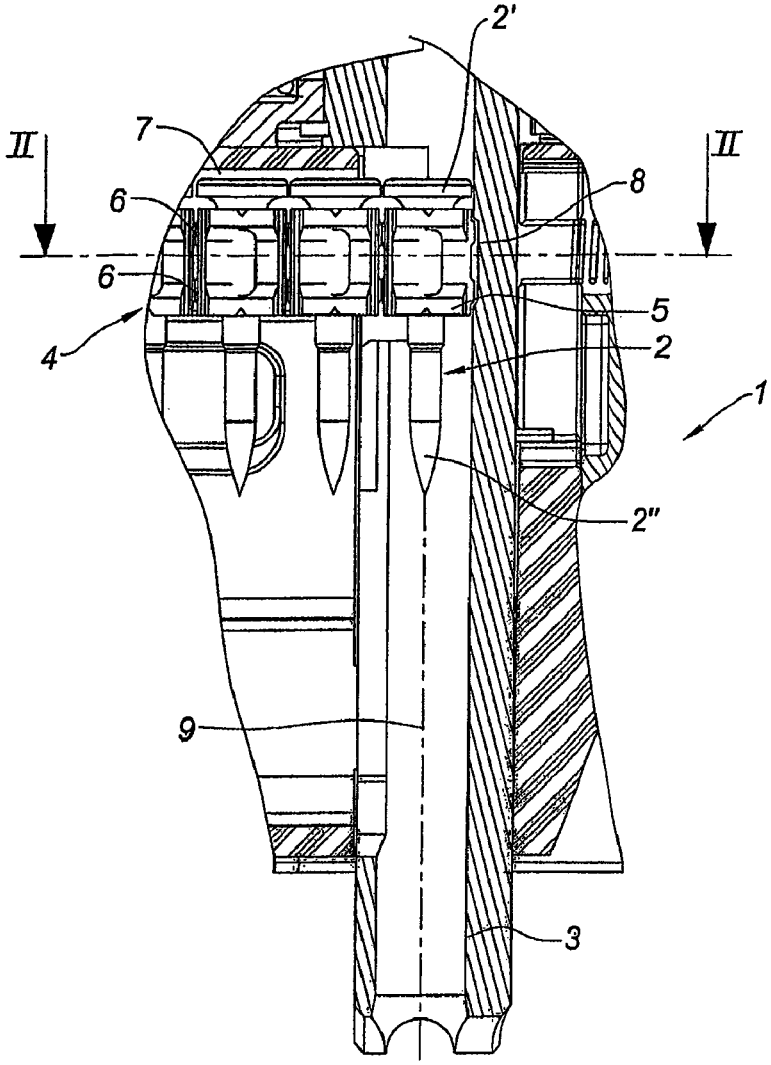
Fig. 1 Prior Art
FIG. 1 is an axial section of a fastening device of the prior art.
Figure 2:
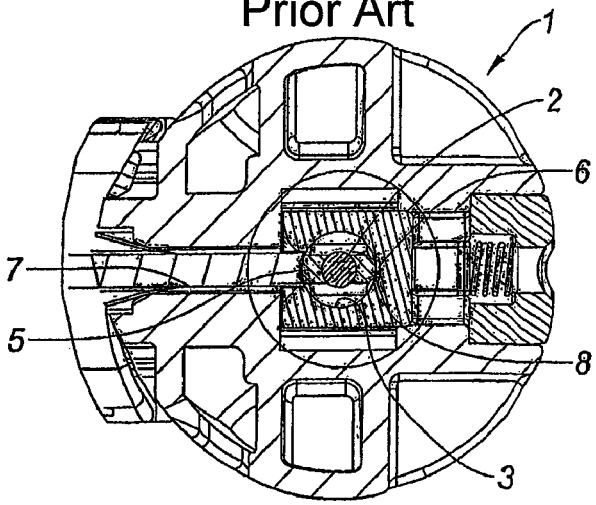
Fig. 2 Prior Art
FIG. 2 is an axial section along the plane II-II of the device of FIG. 1.
Figure 3:
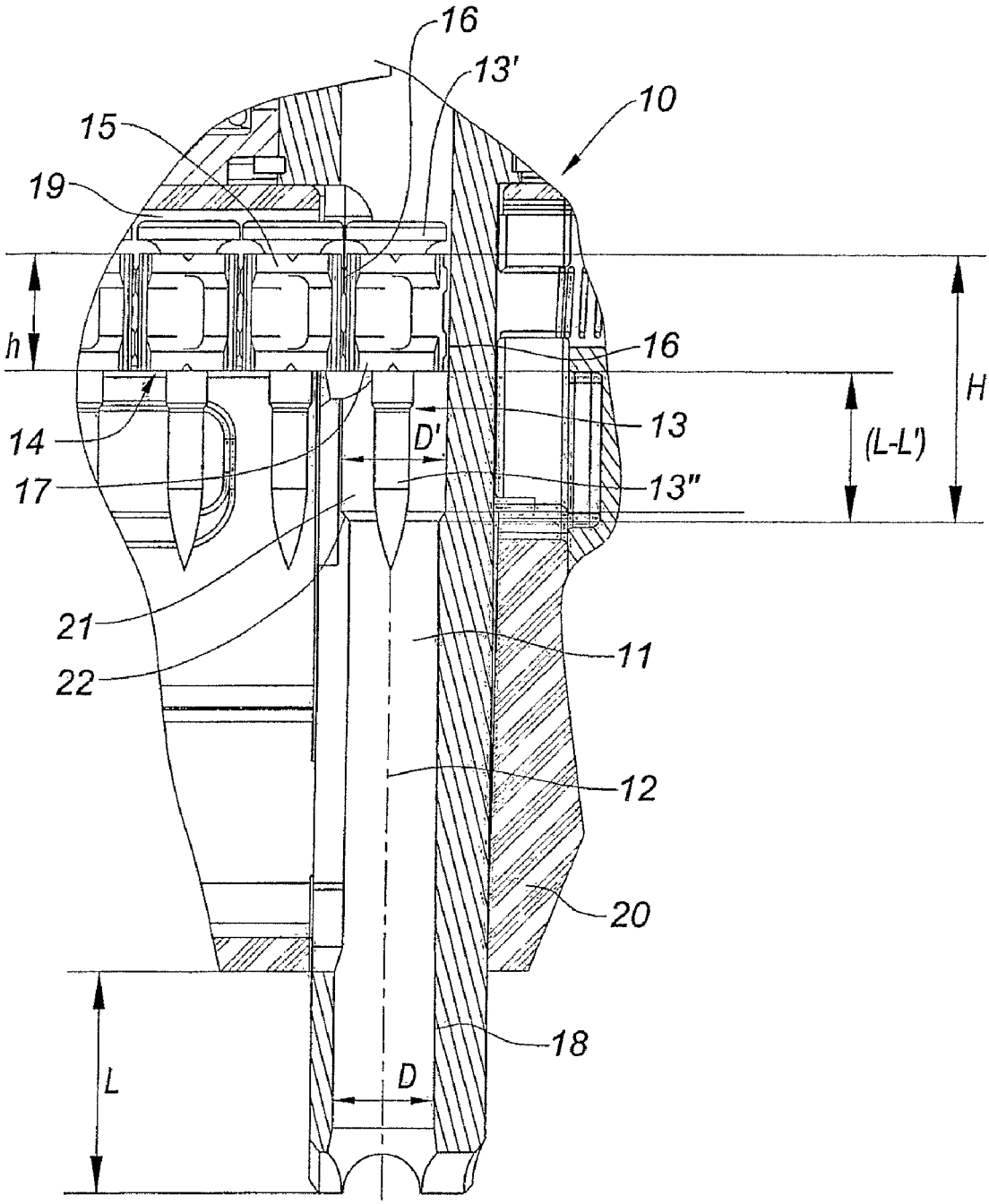
FIG. 3 is an axial section of the preferred embodiment of the fastening device of the invention, with its plug guide in the safety position.

Referring to FIG. 3, the indirect fire fastening device 10 of the invention comprises a piston (not shown) mounted to move in translation in a barrel (not shown) and a cylindrical plug guide 11 having a circular section having a diameter D extending along an axis 12. A fastener 13 loaded into the plug guide 11 can be driven into a substrate material by the piston by the action of a propellant mixture, its stroke being guided by the plug guide 11. The propulsion can be, e.g. powder propulsion or gas propulsion.

The fasteners 13 are in this case metal nails, or plugs, including a head 13' and a shank 13" with a pointed end. The nails 13 are loaded into the device 10 in the form of a strip 14 of nails 13. Each nail 13 is engaged and held by means of its shank 13" in a plastic sleeve 15 of substantially cylindrical shape including a central cylindrical bore for receiving the shank 13" of the nail 13. The external shape of the sleeves 15 is not necessarily regular and may include recesses, flat portions, etc. Irrespective of this shape, which is not described here as it is not necessary for an understanding of the invention, the sleeve 15 has a generally substantially cylindrical surface portion 17 having a maximum diameter corresponding at least in part to that of the head 13' of the nail 13 it receives. This diameter is adapted to be substantially equal to the diameter D of the bore of the plug guide 11. This portion 17 is situated on the part of the sleeve opposite the head 13' of the nail 13 in order to ensure that the nail 13 is guided over the surface 18 of the bore of the plug guide 11 in cooperation with the head 13' of the nail 13.

The sleeves 15 are connected together by diametrically opposing shearable bridges 16 on each sleeve 15. The bridges 16 are in the form of longitudinal rectilinear ribs projecting over the surface of the sleeves 15. They are in this case two in number and are aligned on either side of a sleeve 15, each having a length representing approximately a quarter of the length h of the sleeve 15. The nails 13 are thus disposed in parallel within the strip 14, the sleeves 15 holding them being connected in pairs by the bridges 16.

The fastening device 10 of the invention is adapted to receive a magazine 19 for receiving a strip 14 of nails 13. This magazine 19 is mounted in such a manner that it extends perpendicularly to the axis 12 of the plug guide 11, one of its ends opening into the plug guide 11. The strip 14 is placed in the magazine 19, the fastening assemblies (13, 15) extending parallel to one another and to the axis 12 of the plug guide 11. A return spring (not shown) placed at the end of the magazine 19 opposite the plug guide 11 pushes the strip 14 in the direction of the plug guide 11. The fastening assembly (13, 15) opposite the spring is consequently introduced into the plug guide 11.

For conventional safety reasons, the plug guide 11 of the fastening device 10 must be brought to bear against the substrate material for firing to be possible. In FIG. 3, the device 10 is in the safety position, its plug guide 11 projecting from the casing 20 of the device 10 by a length L. When the plug guide 11 is brought to bear against the substrate material by the user, who applies a force in the direction of this substrate, the plug guide 11 is inserted into the casing 20 until it comes to a stop, a mechanism ensuring that the device is loaded in this position, in which it is therefore in the firing position. In this position shown in FIG. 4, in the case of the last fastener 13, the plug guide 11 only projects beyond the casing 20 by a length L', smaller than the length L. The length over which the plug guide 11 is inserted when the device 10 is loaded, i.e. the distance L-L' will be referred to as the stroke of the plug guide 11 for loading the device 10, or the loading stroke (L-L').

The bore of the plug guide 11 comprises a zone having an enlarged circular section 21 at the opening of the magazine 19 leading into the plug guide 11. Its function is to allow for free rotation of a sleeve 15 in the plug guide 11 prior to firing, i.e. to allow for the free rotation of the sleeve 15 in spite of the presence of the bridges 16 or bridge portions 16 remaining rigidly connected to the sleeve 15 after shearing by the action of the piston.

In this case, this function is principally advantageous for the last fastening assembly (13, 15) of the strip 14, since, as has been seen hereinbefore, when an assembly (13, 15) is rigidly connected to other assemblies (13, 15), it remains in the axis of the strip 14. In this case, the zone having an enlarged section 21 fulfils the same function as the groove 8 of the prior art.

The zone having an enlarged section 21 in this case has a diameter D' substantially equal to the diameter D of the plug guide 11 increased by the radial dimensions of two half bridges 16, i.e. one bridge 16. A half bridge is understood to be the bridge portion 16 remaining rigidly connected to a sleeve 15 after shearing. As the shearing of the bridges 16 is not necessarily precise, the radial dimensions of the bridge portions 16 remaining rigidly connected to a sleeve after shearing is random, varying slightly around average dimensions equal to half the radial dimensions of a bridge. The diameter D' can take this uncertainty into consideration, in the knowledge that slight play is not necessarily unacceptable.

The last fastening assembly (13, 15) may moreover not include bridges 16 on its free side corresponding to the end of the strip 14. The diameter D' may then be substantially equal to the diameter D of the bore of the plug guide 11 increased by the radial dimensions of a half bridge 16.

Be that as it may, the diameter D' of the zone having an enlarged section 21 is adapted to the sleeves used and/or to the play to be tolerated by the person skilled in the art. He will adjust this in accordance with his wishes and constraints.

Figure 4:
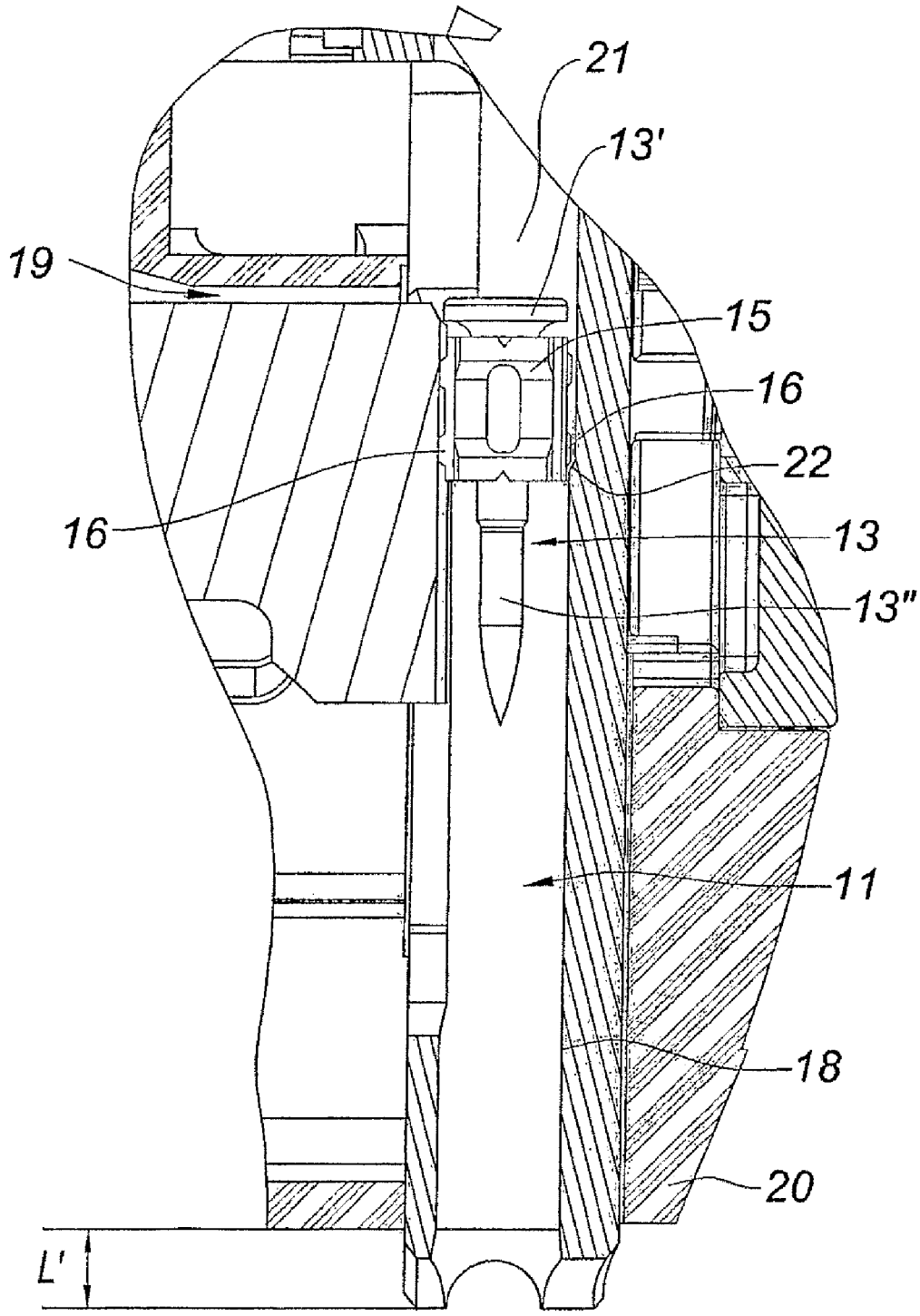
FIG. 4 is an axial section of the preferred embodiment of the fastening device of the invention, with its plug guide in the firing position for the last fastener.

In the embodiment of the invention described here, referring to FIG. 4, the sleeve 15 of the last assembly (13, 15) also comprises on its free part half bridges 16 which have no useful function other than to make the last sleeve 15 substantially identical to the others. The diameter D' of the zone having an enlarged section 21 is thus in this case substantially equal to the diameter D of the bore of the plug guide 11 increased by the radial dimensions of a bridge 16. The person skilled in the art will adapt this diameter D' more precisely to the constraints with respect to play and manufacturing tolerances.

It will be clear that the opening of the magazine 19 leading into the plug guide 11 is adapted to complete the section of the zone having an enlarged section 21. The rotation of the last fastening assembly (13,15) is therefore not obstructed in the latter.

The zone having an enlarged section extends longitudinally over a distance H. This distance corresponds at least to the length h of a sleeve 15 increased by the loading stroke (L-L') downstream in the direction of displacement of the piston for firing when the plug guide 11 is in the safety position. In this manner, during the loading of the device 10, the plug guide 11 ascends without changing the section for the sleeve 15 which is situated in the plug guide 11 in the firing position. The connection with the plug guide 11 portion having a diameter D corresponding to the diameter of a sleeve 15 without the bridges 16 is produced here by a truncated portion 22. The latter allows for correct centring of the fastening assembly (13,15) when this assembly (13,15) is driven by the piston and when it passes from the zone having an enlarged section 21 to the zone having a non-enlarged section having diameter D, i. e. to the remainder of the bore of the plug guide 11. Ill this latter zone, the half bridges 16 are flattened against the surface 18 of the bore of the plug guide 11.

The zone having an enlarged section 21 in this case extends longitudinally downstream over the distance H=h+(L-L') from the upstream end of a sleeve 15 when it is introduced into the plug guide 11. Upstream, the person skilled in the art will decide whether or not to extend this zone having an enlarged section or to adapt the section to the diameter of the piston.

The operation of the fastening device 10 of the invention will now be described in more detail.

A strip 14 of fastening assemblies (13,15) is received in the magazine 19. The assembly (13, 15) opposite the return spring is introduced into the plug guide 11, which is in the safety position. This assembly (13,15) is contained, together with its bridges 16, in the zone of the plug guide 11 with an enlarged section 21, dimensioned to this end. The plug guide 11 is brought to bear against the substrate material by the user and is inserted into the casing 20 as far as its firing position.

The plug guide 11 slides freely around the sleeve 15 of the assembly (13,15) contained therein as a result of the downstream extension of its zone having an enlarged section 21 over the length (L-L') of its loading stroke, wherein the downstream end of the sleeve 15 can come to bear against its truncated portion 22 at the end of the stroke. The piston is driven by the explosive mixture upon firing and drives the assembly (13,15) into the plug guide 11, the centring of this assembly (13,15) being facilitated by the truncated portion 22 for connection with the zone of the plug guide 11 having a non-enlarged section. The bridges 16 of the assembly (13,15) rigidly connected to the strip 14 are sheared. They are then flattened, together with the bridges 16 which are free, against the surface 18 of the bore of the plug guide 11. The fastener 13 is then introduced into the substrate material.

As a result of the departure of the assembly (13,15) from the plug guide 11 and of the force exerted by the return spring, the next assembly (13,15) is introduced into the plug guide 11 when the latter has resumed its safety position and the piston has ascended to the firing position. The device 10 then functions in the same manner for each of the assemblies (13,15) until the last one. This last assembly, which is not rigidly connected to any other, can be made to rotate about is axis by friction against, inter alia, a wall of the magazine 19 when it is introduced into the plug guide 11. This rotation has no influence on the positioning of this last assembly (13,15) in the plug guide 11, as it is allowed for by the zone having an enlarged section 21.

The invention claimed is:

1. Indirect fire device for fixing fasteners in a substrate material, comprising a piston for driving a fastener movably mounted in a barrel and a plug guide for guiding a fastener towards the substrate material, the device being adapted to receive a magazine for receiving a strip of fasteners in order to introduce the fasteners one by one into the plug guide, each fastener being held in a sleeve comprising shearable means for connection to another sleeve, wherein the plug guide includes a zone having an enlarged section, and an opening which extends through a side wall of the plug guide in said zone and via which the magazine opens directly into the plug guide.

2. Device according to claim 1, wherein the zone having the enlarged section has a circular section.

3. Device according to claim 2, wherein, as the sleeves are connected together by means of bridges, the zone having the enlarged section has a diameter substantially equal to the diameter of the plug guide increased by the radial dimension of a bridge.

4. Device according to claim 1, wherein the zone having the enlarged section extends axially over the length of a sleeve increased by the stroke of the plug guide for loading the device.

5. Device according to claim 1, wherein the zone having the enlarged section is connected by a truncated portion to the remainder of the plug guide.

6. A device for fixing fasteners in a substrate material, said device comprising:

a casing;

a piston moveable in said casing for driving a fastener forwards; and a fastener guide moveably mounted at a front end of said casing, said fastener guide being retractable from a front position rearwardly axially relative to said casing to a rear position where firing of said device is permitted;

wherein said fastener guide includes a front zone for guiding the fastener forwards towards the substrate material; and a rear zone having an enlarged cross-section greater than a cross-section of the front zone;

wherein said device is adapted to receive a magazine containing a strip of fasteners in order to introduce the fasteners one by one into the fastener guide, said strip comprising a plurality of sleeves each of which holds one of the fasteners and is connected to an adjacent sleeve by a shearable connection;

wherein the rear zone having the enlarged cross-section is located at the opening of the magazine leading into the fastener guide; and wherein the rear zone extends axially over a distance $$H=h+(L-L')$$

where h is an axial length of each sleeve, and (L-L') is a loading stroke of the fastener guide from the front position to the rear position.

7. The device according to claim 6, wherein the enlarged cross-section of the rear zone is a circular cross-section.

8. The device according to claim 6, wherein the rear zone has a diameter substantially equal to a diameter of the front zone plus a radial dimension of the shearable connection between adjacent sleeves.

9. The device according to claim 6, wherein the fastener guide further includes a truncated portion connecting the front and rear zones for correct centering of the fastener being driven by the piston when the fastener moves from the rear zone having the enlarged cross-section into the front zone of the fastener guide.

10. A device for fixing fasteners in a substrate material, said device comprising:

a casing;

a piston moveable in said casing for driving a fastener forwards;

a fastener guide moveably mounted at a front end of said casing, said fastener guide being retractable from a front position rearwardly axially relative to said casing to a rear position where firing of said device is permitted; and a magazine containing a strip of fasteners, said strip comprising a plurality of sleeves each of which holds one of the fasteners and is connected to an adjacent sleeve by a shearable connection;

wherein said fastener guide includes a front zone for guiding the fastener forwards towards the substrate material; and a rear zone having an enlarged cross-section greater than a cross-section of the front zone;

wherein the fastener guide includes an opening which extends through a side wall of the plug guide in the rear zone and via which the magazine opens directly into the rear zone of the fastener guide in order to introduce the fasteners one by one into the fastener guide at said rear zone; and wherein the rear zone extends axially over a distance $$H=h+(L-L')$$

where h is an axial length of each sleeve, and (L-L') is a loading stroke of the fastener guide from the front position to the rear position .

11. The device according to claim 10, wherein the enlarged cross-section of the rear zone is a circular cross-section.

12. The device according to claim 11, wherein the rear zone has an inner diameter substantially equal to an inner diameter of the front zone plus a radial dimension of the shearable connection between adjacent sleeves.

13. The device according to claim 11, wherein the rear zone has an inner diameter substantially equal to an inner diameter of the front zone plus a half of a radial dimension of the shearable connection between adjacent sleeves.

14. The device according to claim 11, wherein the fastener guide further includes a truncated portion connecting the front and rear zones for correct centering of the fastener being driven by the piston when the fastener moves from the rear zone having the enlarged cross-section into the front zone of the fastener guide.

15. The device according to claim 10, wherein the fastener guide further includes a truncated portion connecting the front and rear zones; and when the fastener guide is in the rear position prior to firing of one of the fasteners of the strip received in the rear zone of the fastener guide, the connection on at least one side of the sleeve holding said one fastener rests on said truncated portion.

16. The device according to claim 10, wherein prior to firing of one of the fasteners of the strip received in the rear zone of the fastener guide, the sleeve holding said one fastener is rotatable within said rear zone without being limited by any groove in an internal circumferential face of the side wall of said rear zone of said fastener guide.

* * * * *